US006105200A

United States Patent [19]

Cooper

[11] Patent Number: 6,105,200

[45] **Date of Patent: *Aug. 22, 2000**

[54] CAN TOP CLEANING DEVICE

[76] Inventor: Byron W. Cooper, 1910 Messina Dr., San Jose, Calif. 95132

[ * ] Notice: This patent is subject to a terminal disclaimer.

[21] Appl. No.: 09/384,726

[22] Filed: Aug. 27, 1999

Related U.S. Application Data

[63] Continuation-in-part of application No. 09/063,759, Apr. 21, 1998, Pat. No. 5,996,169.

[51] Int. Cl.[7] ..... A47L 25/00

[52] U.S. Cl. ..... 15/257.01; 15/105; 15/210.1; 7/151; 81/3.09

[58] Field of Search ..... 15/105, 210.1, 15/236.01, 236.07, 236.09, 257.01; 7/751; 81/3.09, 3.55

[56] References Cited

U.S. PATENT DOCUMENTS

| | | | |
|---|---|---|---|
| 2,323,621 | 7/1943 | Penney | 7/151 |
| 2,514,566 | 7/1950 | Capriccio | 7/151 |
| 3,604,047 | 9/1971 | Hennigan | 15/236.09 |
| 4,207,781 | 6/1980 | Greenwood | 81/3.55 |
| 4,433,597 | 2/1984 | Rowland | 81/3.09 |
| 4,651,890 | 3/1987 | Coker et al. | 220/85 |
| 4,733,423 | 3/1988 | Blatt | 15/160 |
| 4,813,091 | 3/1989 | Glasener | 15/160 |
| 4,912,801 | 4/1990 | Hammill | 15/160 |
| 4,951,344 | 8/1990 | Alkhato | 15/257.01 |
| 4,967,622 | 11/1990 | Phillips | 81/3.55 |
| 4,979,407 | 12/1990 | Hernandez et al. | 81/3.09 |
| 5,031,264 | 7/1991 | Muster | 15/104.93 |
| 5,244,111 | 9/1993 | Merom | 220/694 |
| 5,371,913 | 12/1994 | Smith | 15/104.94 |
| 5,555,778 | 9/1996 | Otters et al. | 81/3.55 |

FOREIGN PATENT DOCUMENTS

| | | | |
|---|---|---|---|
| 2010381 | 9/1971 | Germany | 81/3.55 |

OTHER PUBLICATIONS

Hillyard Industries; H–101 Technical Data and Material Data Safety Sheet prepared Feb. 8, 1994.

*Primary Examiner*—Robert J. Warden, Sr.
*Assistant Examiner*—Theresa T. Snider

[57] ABSTRACT

A can cleaning device having a main body and front edge, and a wall depending from the main body along the front edge for use with a disposable moist towelette to clean and sanitize a top surface and a tight circumferential groove on the top of a pop top beverage can. The can cleaning device is guided into place on top of the moist towelette, forcing a portion of the moist towelette into the tight groove on the top of the can, rotating the can cleaning device relative to the can effects cleaning and sanitizing or disinfecting of the top surface and groove on the can. The can cleaning device may be attached to a counter top, vending machine, vending cart, store counter, cooler, refrigeration unit, serving cart or similar place for storing or dispensing pop top beverage cans.

34 Claims, 3 Drawing Sheets

CAN TOP CLEANING DEVICE

CROSS-REFERENCES TO RELATED APPLICATIONS

This application is a continuation-in-part of application Ser. No. 09/063,759, filed Apr. 21, 1998, U.S. Pat. No. 5,996,169 for CAN TOP CLEANING DEVICE, the disclosure of which is incorporated herein by this reference. This application is related to application Ser. No. 09/343,433, filed Jun. 30, 1999, for CAN TOP CLEANING TOWELETTE, the disclosure of which is incorporated herein by this reference, and is related to application Ser. No. 09/343,495, filed Jun. 30, 1999, for CAN TOP CLEANING METHOD, the disclosure of which is incorporated herein by this reference.

BACKGROUND OF THE INVENTION

The present invention relates to cleaning implements and more particularly, to a convenient cleaning device for scrubbing or otherwise cleaning the top surface and groove on pop top beverage cans.

Pop top cans are well known and widely used for the storage and consumption of soft drinks and other cold beverages. The popularity of the non-breakable air-tight can is due in part to its convenience as a means for storing and consuming small quantities of carbonated beverages. However, the cans often become contaminated with dirt and other debris during packaging, storage and transportation to retail outlets and vending machines where they are purchased by the consumer. The present design of these cans allows such contaminants to accumulate in a tight groove on the top of the can.

The tight groove on the top of pop top cans is not easily or conveniently cleaned. It is common for consumers to purchase beverages in pop top cans from convenience stores and vending machines and immediately consume the contents therefrom, ingesting portions of the contaminants. Attempts at cleaning the top of the can with a napkin, paper towel, portions of clothing or other cloth alone rarely produces adequate results and often leads to frustration.

Proper cleaning of the tight groove on the top of pop top cans requires a brush or utensil which is often not readily available to the consumer immediately after purchasing the can. Various types of brushes for cleaning cans are known in the prior art. However, none of the existing devices are convenient for everyday carrying and use by consumers.

SUMMARY OF THE INVENTION

The present invention is directed to a can cleaning device for cleaning the top surface and groove on pop top cans. In particular, the invention is directed to a can cleaning device comprising a main body having a front edge and a wall depending from the main body along the front edge for use with a moist towelette for cleaning the top surface and groove on pop top cans.

Accordingly, the present invention provides a novel and expedient device for cleaning the top surface and groove on pop top cans or similar containers. The pop top can cleaning device and towelette are small enough to be placed in clothing pockets, a purse, or other convenient place where the cleaning device and towelette would be available for immediate use.

Other features and advantages of the invention will appear from the following description in which the preferred embodiments have been set forth in detail in conjunction with the accompanying drawings however, the invention is not limited to these specific embodiments.

DESCRIPTION OF THE SPECIFIC EMBODIMENTS

Figure 1:
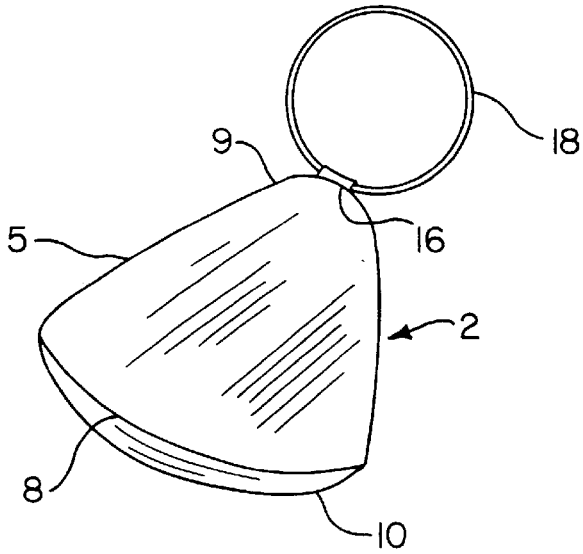
FIG. 1 is a perspective top view of a can cleaning device made according to the invention having an ornament, a key ring and loosely connected to a cooler.

Referring to FIGS. 1 to 5, there is illustrated the can cleaning device, generally designated by reference numeral 2, for use with a moist towelette. A preferred embodiment of can cleaning device 2 is shown in FIG. 1 being generally triangular in shape and having a main body 5, a front edge 8, and a wall 10 depending from front edge 8.

Figure 3:
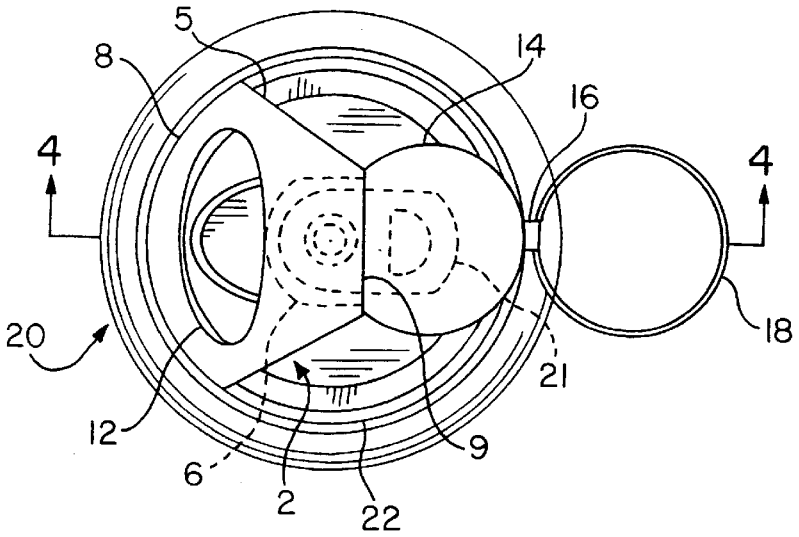
FIG. 3 is a planer top view of a pop top can, and a can cleaning device made according to the invention having a handle, bottle opener, and key ring.
Figure 4:
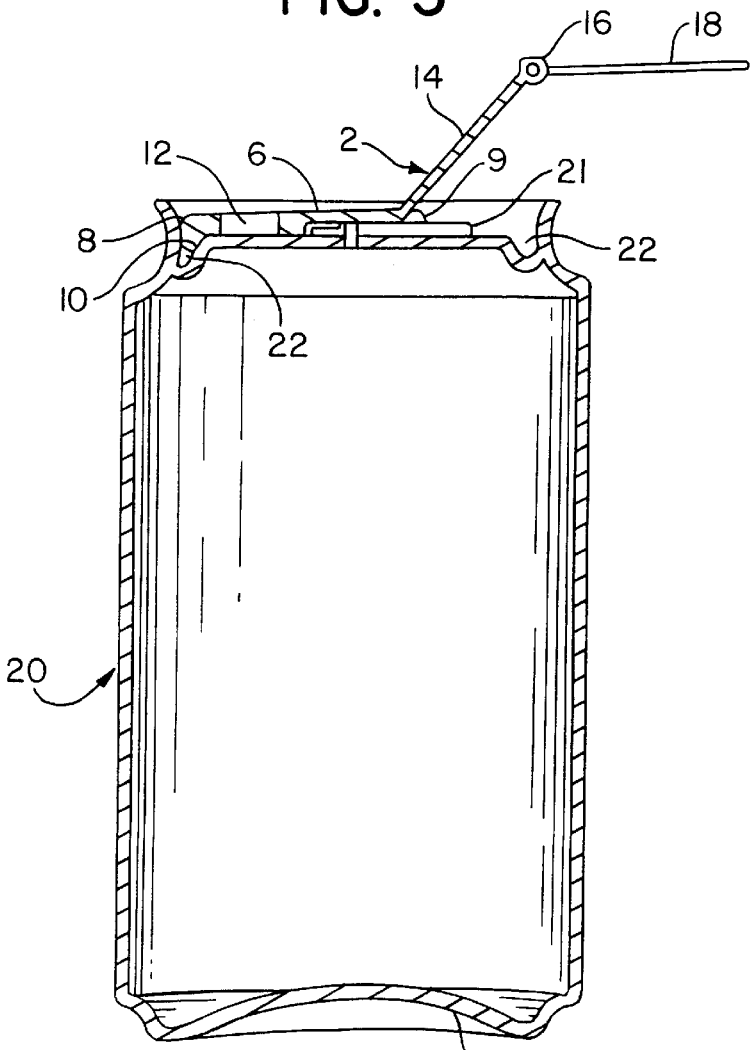
FIG. 4 is a cross sectional view of a pop top can and a can cleaning device made according to the invention, taken along line 4—4 of FIG. 3.
Figure 5:
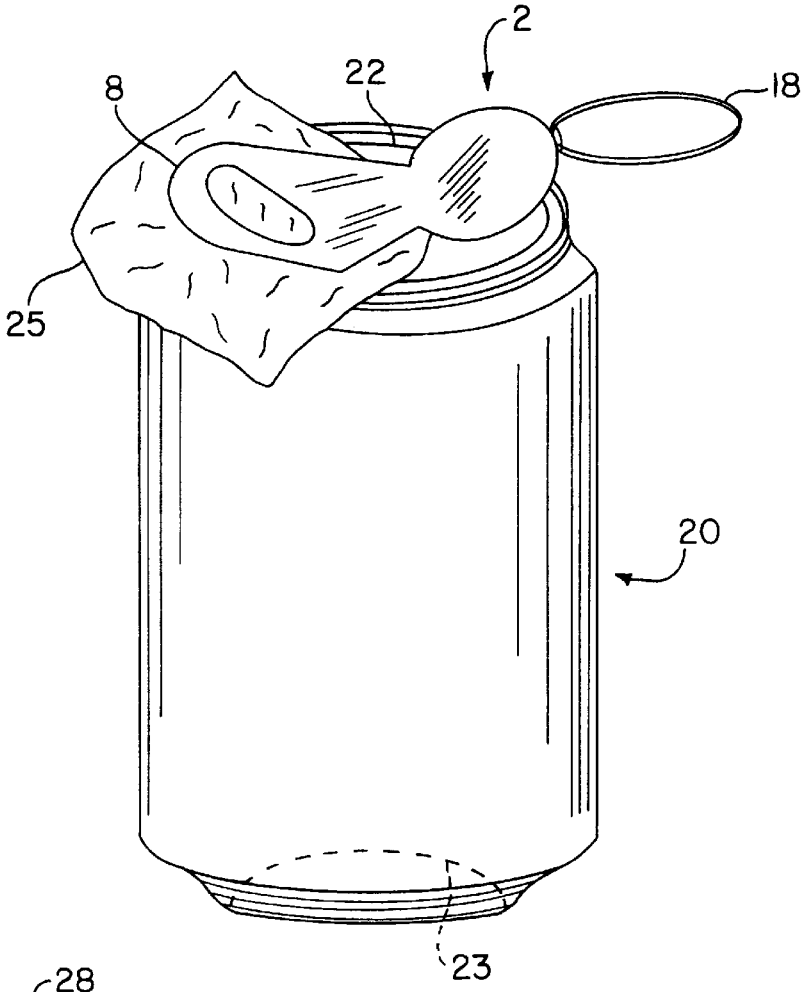
FIG. 5 is a perspective view of a pop top can with a can cleaning device and towelette in position according to the invention.

The can cleaning device may take any general shape. However, the curvature of front edge 8 is designed to conform to the radial curvature of a pop top can 20 as can be seen in FIGS. 3, 4 and 5. The arc distance of front edge 8 can be more than one-half the circumference of the pop top can however, it has been found with respect to overall size and ease of use of the can cleaning device that the circumference of front edge 8 be less than one-half the circumference of can 20. Depending downwardly from front edge 8 is a wall 10 which is shaped to fit into a groove 22 on the top of can 20 as can best be seen in FIG. 4.

Referring to FIGS. 1, 4 and 5, embodiments of cleaning device 2 have a handle 14 (FIGS. 4, 5) attached to main body 5 at a back edge 9 or may have a key ring 18, a chain, cable, string, cord, or similar device attached to main body 5 (FIG. 1) or handle 14 (FIGS. 4, 5) for ease of carrying and use, or for loosely connecting the device to a pop top can dispensing means where pop top cans are purchased, held, or dispensed for immediate consumption of their contents. As used herein, pop top can dispensing means includes, but is not limited to a counter top, vending machine, vending cart, store counter, cooler, refrigeration unit, serving cart or similar place for storing or dispensing pop top beverage cans. Referring to FIG. 1, cleaning device 2 may be loosely connected to cooler 3 or other pop top can dispensing means by key ring 18 and cord 19 or by a chain, rope, cable, magnet or similar device attached to cleaning device 2 and to the dispensing means which allows cleaning device 2 to be moved or temporarily removed with respect to the dispensing means for use in cleaning a pop top can. Loosely connected as used herein means connected by way of other objects such as a key ring, chain, rope, cord, cable, magnet or similar device which allows the loosely connected devices to be moved independently or one removed from the other with ease. Key ring 18, a chain, cable, string, cord, or similar device, may be connected to main body 5 (FIG. 1) or handle 14 (FIGS. 4, 5) by any method, including integral attachment to main body 5 or handle 14, the use of a ring holder 16 or by drilling a hole directly into main body 5 or handle 14.

Figure 2:
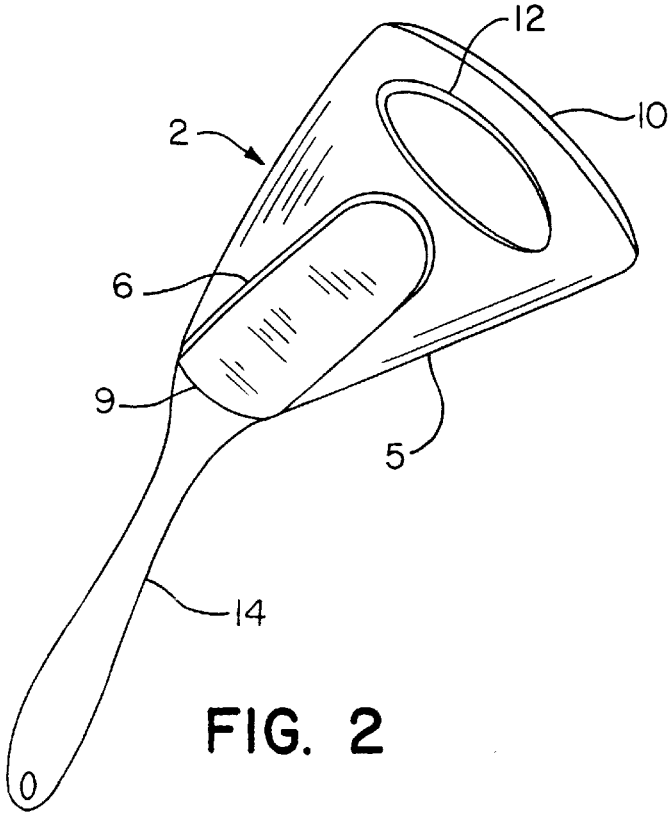
FIG. 2 is a perspective bottom view of a can cleaning device made according to the invention having a handle and bottle opener.

Embodiments of cleaning device 2 contain a bottle opener 12 which is cut from main body 5 as shown in FIGS. 2, 3, and 4. Embodiments of cleaning device 2 also have a channel 6 cut into the bottom of main body 5 to fit over a pull tab 21 on the top of can 20 as best shown in FIGS. 2, 3 and 4. Perpendicular wall 10 may be used as a tab puller by inserting perpendicular wall 10 under tab 21 on the top of can 20 and pulling upward.

Can cleaning device 2 can be made of any type of solid or flexible material including wood, metal, plastic or similar suitable material. Preferred embodiments are light in weight and small for ease of carrying and use. Referring to FIGS. 1, 3 and 5, embodiments of cleaning device 2 contain a surface on main body 5 or handle 14 for attaching an ornament 7 thereon (FIG. 1). Examples of ornaments include, but are not limited to, a picture holder, trademark, company logo, sports team logo, college logo, or similar ornament for display. An ornament may be attached to cleaning device 2 by integrating a frame on main body 5 or handle 14 or by affixing the ornament directly to main body 5 or handle 14.

Referring to FIGS. 3, 4 and 5, can cleaning device 2 is intended for use with a towelette. The term towelette as used herein generally includes any napkin, paper towel, tissue, fabric, cloth or similar material. Can cleaning device 2 is used by placing a moist towelette 25, or similar clean material, on top of can 20 and next placing can cleaning device 2, or similar cleaning implement, over moist towelette 25 while guiding wall 10 down into groove 22 of can 20. Pull tab 21 on top of can 20 fits into channel 6 of can cleaning device 2. Once properly in place, can cleaning device 2 is manipulated by applying pressure with one's thumb downward onto main body 5 and rotating can cleaning device 2 back and forth until the top and groove 22 of can 20 are clean. Preferred embodiments of can cleaning device 2 having handle 14 or key ring 18 provide an additional appendage for grasping with one's fingers and palm while applying pressure with one's thumb and rotating can cleaning device 2. After the surface has been cleaned the soiled moist towelette 25, napkin, paper towel, tissue or similar material may then be properly discarded.

Figure 6:
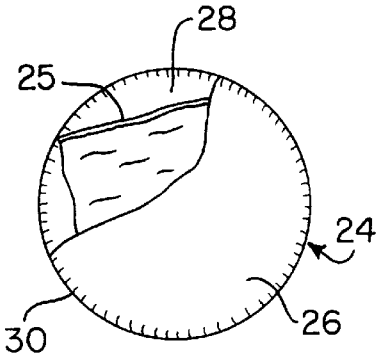
FIG. 6 is a cut away perspective view of a packaged moist towelette made according to the invention.

Although can cleaning device 2 can be used with a napkin, paper towel, tissue or similar readily available clean material, best results in cleaning the top and groove 22 of can 20 are obtained by using moist towelette 25 of the present invention as shown in FIGS. 5 and 6. Moist towelette 25 is best suited for cleaning the top and groove 22 of can 20 where it is moistened with a liquid designed to enhance the removal of dirt or reduce germs and bacteria on the surfaces and groove to be cleaned. A can 20 cleaned with moist towelette 25, moistened with an appropriate cleaning or disinfecting solution, provides a more sanitary surface from which a consumer can directly ingest liquids.

Although packaged moist towelettes are known in the prior art, none are designed for use on pop top cans or for use with a can cleaning device. Prior art packaged moist towelettes are heavily perfumed and contain lotions and cleaning solvents in concentrations which are not suitable for use on pop top cans which often come into direct contact with a consumer's mouth. The odor and taste of perfumes, lotions and cleaning solvents used in prior art moist towelettes makes their use to clean pop top cans undesirable, especially where the odor and taste of the residue left on the can would detract from enjoyment of the beverage when consumed directly from the can.

Moist towelette 25 can be made of any material which resists tearing when manipulated with cleaning device 2 or similar cleaning implement. The preferred embodiment of moist towelette 25 is moistened with a liquid capable of assisting in the removal of dirt and debris from groove 22, or in disinfecting or sanitizing any surface and groove 22 on the top of can 20.

The liquid used to moisten the preferred embodiment of moist towelette 25 should not present an objectionable odor or taste after it is applied to can 20. The liquid may be water alone however, the preferred embodiment is water with a sanitizer, anti-bacterial, or anti-germ agent. The concentration of sanitizer, anti-bacterial, or anti-germ agent should be sufficient to reduce contamination, germs and bacteria on the top surface and groove 22 of can 20 without leaving a persistent residue with a perceptible taste or odor after using moist towelette 25 to clean can 20.

Many commonly available sanitizers, detergents, anti-bacterial, or anti-germ agents contain no perfumes, are non-toxic in small concentrations and have no perceptible taste or odor in small concentrations. One example is the sanitizer H-101, produced by Hillyard, Inc., which is clear, does not have an objectionable odor in small concentrations, contains no perfumes and is formulated for cleaning and sanitizing surfaces that come in contact with food or beverages. The sanitizer H-101, or similar sanitizers, may be added to water in small concentrations and the solution used to moisten towelette 25. A solution of water with a concentration of less than 10 percent by weight sanitizer is suitable for wiping the top surface and groove 22 of can 20. A preferred embodiment contains 99 percent water by weight and 1 percent sanitizer such as H-101.

An example of an anti-bacterial and anti-germ agent which is non-toxic in small concentrations and has no perceptible taste or odor in small concentrations is the chemical agent benzalkonium chloride. Benzalkonium chloride, or similar agents, may be added to water in small concentrations and the solution used to moisten towelette 25. A solution of water with a concentration of less than 0.2 percent by weight benzalkonium chloride is suitable for wiping the top surface and groove 22 on can 20. A preferred embodiment has 99.93 percent water by weight and 0.07 percent benzalkonium chloride.

The solution used to moisten towelette 25 may also contain a surfactant and other ingredients such as a detergent, defoamer and preservatives so long as the additives are used in concentrations which are non-toxic and do not leave an objectionable odor or taste when applied to can 20.

Figure 7:
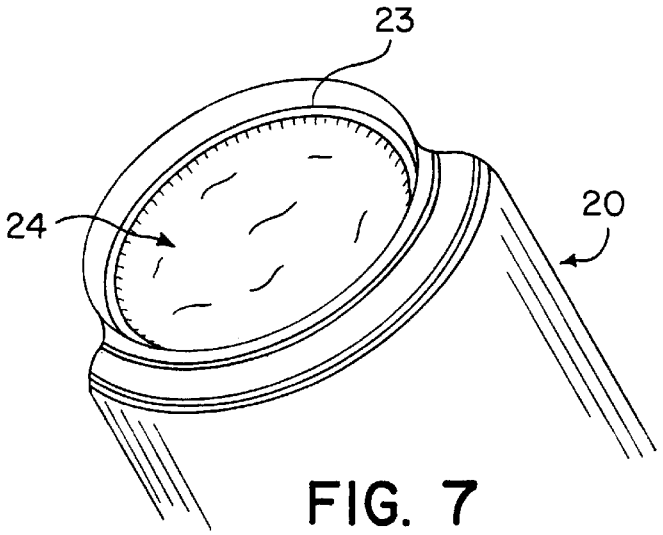
FIG. 7 is a perspective bottom view of a pop top can with a packaged moist towelette attached according to the invention.

Referring to FIGS. 6 and 7, moist towelette 25 may be stored in a packet 24 to preserve the towelette's moisture and cleanliness until the towelette is ready for use. Packet 24 has a packet top 26 and packet bottom 28. Moistened towelette 25 is placed between the packet top and packet bottom and sealed along packet edge 30. Packet 24 may be sealed air tight to prevent the escape of moisture from the towelette and to prevent contamination of the towelette. The preferred embodiment of moist towelette packet 24 is vacuum sealed.

Packet 24 may be any shape or size however, the preferred embodiment is generally round in shape. A generally round packet 24 can be attached to well 23 on the bottom of can 20, especially when packet 24 is circumferentially smaller than the outer wall of well 23 as can best be seen in FIG. 7. Packet 24 can be attached to any part of can 20 with double sided tape, glue, or any other method of attachment. Attaching packet 24 to can 20 provides a convenient means of dispensing the moist towelette packet from vending machines along with the beverage can. Can cleaning device 2 can be attached to a vending machine with a chain or cable for immediate use with moist towelette 25 in packet 24 when can 20 is dispensed from the vending machine.

Although only specific embodiments of the present invention are shown and described herein, the invention is not limited by these embodiments. Rather, the scope of the invention is to be defined by these descriptions taken together with the attached claims and their equivalents.

What is claimed is:

1. A can cleaning device for use with a towelette to clean a top surface and a tight circumferential groove on the top of a pop top beverage can, comprising:

a main body having a front edge, said front edge having a curvature substantially equal to the radial curvature of a circumferential groove on the top of a beverage can; and a wall having a curvature substantially equal to the radial curvature of said circumferential groove on the top of said can, said wall connected to and depending downward along said front edge and having a shape allowing said wall to fit into said groove when in place on the top of said can such that when a towelette is placed over the top surface of said can and said can cleaning device is guided into place on top of said towelette with said wall fit into said groove, rotating said can cleaning device relative to said can effects cleaning of the top surface and said groove on said can.

2. A can cleaning device as described in claim 1, further comprising a bottle top opener cut from said main body.

3. A can cleaning device as described in claim 2, further comprising an ornament connected to said main body.

4. A can cleaning device as described in claim 2, wherein said main body is loosely connected to a pop top can dispensing means.

5. A can cleaning device as described in claim 1, further comprising a handle connected to said main body.

6. A can cleaning device as described in claim 5, further comprising a key ring connected to said handle.

7. A can cleaning device as described in claim 6, further comprising an ornament connected to said main body.

8. A can cleaning device as described in claim 6, further comprising an ornament connected to said handle.

9. A can cleaning device as described in claim 6, wherein said handle is loosely connected to a pop top can dispensing means.

10. A can cleaning device as described in claim 5, further comprising a bottle top opener cut from said main body.

11. A can cleaning device as described in claim 10, further comprising a key ring connected to said handle.

12. A can cleaning device as described in claim 11, further comprising an ornament connected to said handle.

13. A can cleaning device as described in claim 11, wherein said handle is loosely connected to a pop top can dispensing means.

14. A can cleaning device as described in claim 10, wherein said wall is a tab puller.

15. A can cleaning device as described in claim 14, further comprising an ornament connected to said handle.

16. A can cleaning device as described in claim 14, wherein said handle is loosely connected to a pop top can dispensing means.

17. A can cleaning device as described in claim 10, further comprising an ornament connected to said handle.

18. A can cleaning device as described in claim 10, wherein said handle is loosely connected to a pop top can dispensing means.

19. A can cleaning device as described in claim 5, further comprising an ornament connected to said main body.

20. A can cleaning device as described in claim 5, further comprising an ornament connected to said handle.

21. A can cleaning device as described in claim 5, wherein said handle is loosely connected to a pop top can dispensing means.

22. A can cleaning device as described in claim 1, further comprising a key ring connected to said main body.

23. A can cleaning device as described in claim 22, further comprising a bottle top opener cut from said main body.

24. A can cleaning device as described in claim 23, wherein said wall is a tab puller.

25. A can cleaning device as described in claim 24, further comprising an ornament connected to said main body.

26. A can cleaning device as described in claim 23, further comprising an ornament connected to said main body.

27. A can cleaning device as described in claim 23, wherein said main body is loosely connected to a pop top can dispensing means.

28. A can cleaning device as described in claim 22, further comprising an ornament connected to said main body.

29. A can cleaning device as described in claim 22, wherein said main body is loosely connected to a pop top can dispensing means.

30. A can cleaning device as described in claim 1, wherein said wall is a tab puller.

31. A can cleaning device as described in claim 30, further comprising an ornament connected to said main body.

32. A can cleaning device as described in claim 30, wherein said main body is loosely connected to a pop top can dispensing means.

33. A can cleaning device as described in claim 1, further comprising an ornament connected to said main body.

34. A can cleaning device as described in claim 1, wherein said main body is loosely connected to a pop top can dispensing means.

* * * * *